US008136446B2

(12) United States Patent
Ohsawa

(10) Patent No.: US 8,136,446 B2
(45) Date of Patent: Mar. 20, 2012

(54) PLATE FOR ROTARY PROCESSING MACHINE AND METHOD OF MOUNTING OF THE SAME

(75) Inventor: Shin Ohsawa, Tsukuba (JP)

(73) Assignee: Komori Corporation, Tokyo (JP)

( * ) Notice: Subject to any disclaimer, the term of this patent is extended or adjusted under 35 U.S.C. 154(b) by 966 days.

(21) Appl. No.: 12/153,962

(22) Filed: May 28, 2008

(65) Prior Publication Data

US 2008/0295711 A1 Dec. 4, 2008

(30) Foreign Application Priority Data

May 31, 2007 (JP) ..... 2007-144593
Mar. 19, 2008 (JP) ..... 2008-070569

(51) Int. Cl.
*B31F 1/07* (2006.01)
*B41F 21/00* (2006.01)
*B41F 19/02* (2006.01)

(52) U.S. Cl. ..... 101/22; 101/23; 101/415.1

(58) Field of Classification Search ..... 101/22–23, 101/28–29, 389.1, 395, 415.1, 481, 485–486, 101/DIG. 36, 32
See application file for complete search history.

(56) References Cited

U.S. PATENT DOCUMENTS 4,116,594 A 9/1978 Leanna et al.
5,699,742 A * 12/1997 Ahrens et al. ..... 101/486
6,016,752 A * 1/2000 Harari ..... 101/486
6,223,654 B1 * 5/2001 Lindner et al. ..... 101/395
6,845,713 B1 * 1/2005 Schumann et al. ..... 101/477
7,717,035 B1 * 5/2010 Gray ..... 101/23
2006/0086229 A1 4/2006 Pfaff, Jr.

FOREIGN PATENT DOCUMENTS

FR 1 596 950 A 6/1970
WO WO 02/16121 A1 2/2002

* cited by examiner

*Primary Examiner* — Leslie J Evanisko
*Assistant Examiner* — Marissa Ferguson Samreth
(74) *Attorney, Agent, or Firm* — Birch, Stewart, Kolasch & Birch, LLP

(57) ABSTRACT

Provided is a pair of plates for a rotary processing machine having the following configuration and a method of mounting the same by which the pair of plates can be mounted on the respective outer circumferential surfaces of a pair of cylinders with high precision. When a female recessed plate and a male raised plate are overlapped with each other so as to make processing portions of the female plate correspond to those of the male plate, fitting protrusions are fitted into respective fitting portions. Accordingly, the movement of the fitting protrusions is restricted both in the width direction of the plates and in the mount direction of the plates. Concurrently, guiding protrusions are respectively inserted between corresponding pairs of guide protrusions in the guiding portions. Accordingly, the guiding protrusions are guided so that relative movement of the guiding protrusions is allowed only in the mount direction.

18 Claims, 10 Drawing Sheets

PLATE FOR ROTARY PROCESSING MACHINE AND METHOD OF MOUNTING OF THE SAME

BACKGROUND OF THE INVENTION

1. Field of the Invention

The present invention relates to a plate for a rotary processing machine and a method of mounting the same.

2. Description of the Related Art

An exemplary rotary processing apparatus for giving raised and recessed finish to a paper sheet includes, as shown in FIG. 10, a female recessed plate 10 that has a recessed processing portion 11 and a male raised plate 20 that has a raised processing portion 21. A pair of cylinders are provided to mount the plates 10 and 20 on their respective outer circumferential surfaces of the cylinders. The surface of a paper sheet 1 is given a raised and recessed finish (embossed finish) by allowing the paper sheet 1 to pass between the plates 10 and 20 while the cylinders are being rotated. As a reference, see US-A-2006-0086229.

When the above-described rotary processing machine is used, the positions of the plates 10 and 20 with respect to the respective cylinders, or the relative positions of the plates 10 and 20 to the respective cylinders, have to be set with precision. To this end, fine-tuning to the relative positions needs to be carried out by way of test processing. This lowers the working efficiency.

SUMMARY OF THE INVENTION

Such problems occur not only in the case of a plate for a rotary processing machine for embossing the paper sheet but also in the case of a plate for any rotary processing machines used for various processing that includes embossing and punching a sheet, such as a paper sheet, or a web.

In view of the foregoing circumstances, an object of the present invention is to provide a pair of plates for a rotary processing machine and a method of mounting the same with the following features. Each of the pair of plates can be mounted on the outer circumferential surface of the corresponding one of a pair of cylinders with high precision.

A first aspect of the present invention to accomplish the above-described object provides a pair of plates for a rotary processing machine that are mounted respectively on the outer circumferential surfaces of a pair of cylinders. Each of the plates has a processing portion used for performing processing on any one of a sheet and a web that is passed between the cylinders. The plates comprise engagement portions that are provided in a pair. One of the engagement portions is formed in one of the plates and the other one of the engagement portions is formed in the other one of the plates. The engagement portions engage with each other when the plates are overlapped with each other. The engagement of the engagement portions restricts the relative movement of the plates on the front side of the plates in a mount direction in which the plates are mounted on the respective cylinders. The engagement of the engagement portions restricts the relative movement of the plates in the width direction of the plates on the rear side of the plates in the mount direction of the plates on the cylinders, and allows the relative movement of the plates in the mount direction on the rear side.

A second aspect of the present invention provides the pair of plates for a rotary processing machine according to the first aspect in which the engagement portions comprises guide engagement portions including: a guiding protrusion formed so as to protrude on the rear-end side of one of the plates in the mount direction; and a guide portion formed on the rear-end side of the other one of the plates in the mount direction. The guide portion engages with the guiding protrusion so as to guide the movement of the guiding protrusion only in the mount direction.

A third aspect of the present invention provides the pair of plates for a rotary processing machine according to the second aspect, in which the engagement portions comprises fitting engagement portions including: a fitting protrusion formed so as to protrude on the front-end side of one of the plates in the mount direction; and a fitting portion formed on the front-end side of the other one of the plates in the mount direction. The fitting portion is fitted to the fitting protrusion so as to restrict the movement of the fitting protrusion both in the width direction and in the mount direction.

A fourth aspect of the present invention provides the pair of plates for a rotary processing machine according to the second aspect, in which the guide portion of the guide engagement portions is any one of a long hole, a long groove, and a pair of protrusions which sandwich the guiding protrusion from the two sides in the width direction. The selected one of the long hole, the long groove, and the pair of protrusions is formed with the longitudinal side thereof being oriented in the mount direction.

A fifth aspect of the present invention provides the pair of plates for a rotary processing machine according to the fourth aspect, in which the guiding protrusion of the guide engagement portions includes a tapered surface with the size thereof being gradually decreasing towards the tip-end side.

A sixth aspect of the present invention provides the pair of plates for a rotary processing machine according to the fourth aspect, in which the guide portion of the guide engagement portions includes a tapered surface with the size thereof being gradually increasing towards the side from which the guiding protrusions enters.

A seventh aspect of the present invention provides the pair of plates for a rotary processing machine according to the third aspect, in which the fitting portion of the fitting engagement portions is any one of a hole, a groove, and a protrusion.

An eighth aspect of the present invention provides the pair of plates for a rotary processing machine according to the seventh aspect, in which the fitting protrusion of the fitting engagement portions includes a tapered surface with the size thereof being gradually decreasing towards the tip end side.

A ninth aspect of the present invention provides the pair of plates for a rotary processing machine according to the seventh aspect, in which the fitting portion of the fitting engagement portions includes a tapered surface with the size thereof being gradually increasing towards the side from which the fitting protrusions enters.

A tenth aspect of the present invention provides the pair of plates for a rotary processing machine according to the third aspect, in which the guide engagement portions include at least one set of the guiding protrusion and the guide portion. The fitting engagement portions include at least one set of the fitting protrusion and the fitting portion. The total number of sets including the set of guiding protrusion and the guide portion of the guide engagement portions and the set of the fitting protrusion and the fitting portion of the fitting engagement portions is at least three.

An eleventh aspect of the present invention provides the pair of plates for a rotary processing machine according to the third aspect, in which the guiding protrusion of the guide engagement portions and the fitting protrusion of the fitting engagement portions are removable.

A twelfth aspect of the present invention provides the pair of plates for a rotary processing machine according to the eleventh aspect, in which the guiding protrusion of the guide engagement portions and the fitting protrusion of the fitting engagement portions are made of resin.

A thirteenth aspect of the present invention provides the pair of plates for a rotary processing machine according to the first aspect, in which each of the pair of plates is made of any one of a board and a sheet that is flexible so as to be capable of being curved along the outer circumferential surface of each of the cylinders.

A fourteenth aspect of the present invention provides the pair of plates for a rotary processing machine according to the first aspect, in which a batch operation with a single processing machine is performed to form the processing portion and the engagement portion formed in one of the plates as well as a mount reference portion formed in the one of the plates and used to mount the one of the plates on the corresponding one of the cylinders. A batch operation with exposure means is performed to form the processing portion and the engagement portion formed in the other one of the plates.

A fifteenth aspect of the present invention to accomplish the above-described object provides a method of mounting the pair of plates for a rotary processing machine, the pair of plates being recited in the first aspect. The method comprises: positioning one of the plates with respect to the corresponding one of the cylinders, and mounting the one of the plates on the one of the cylinders; engaging the other one of the plates with the one of the plates by means of the engagement portions, and positioning the other one of the plates with respect to the one of the plates; and mounting the other one of the plates on the corresponding other one of the cylinders, with the other one of the plates being positioned to the one of the plates. The position of the other one of the plates thus determined is maintained while the mounting of the other one of the plates is being performed.

A sixteenth aspect of the present invention provides the method of mounting the pair of plates for a rotary processing machine according to the fifteenth aspect, in which the one of the plates is mounted on the outer circumferential surface the one of the cylinders while the one and the other one of the plates that are overlapped with each other with their respective positions being determined by means of the engagement portions are curved along the outer circumferential surface of the one of the cylinders.

A seventeenth aspect of the present invention provides the method of mounting the pair of plates for a rotary processing machine according to the sixteenth aspect, in which the other one of the plates is separated from the one of the plates and mounted on the outer circumferential surface of the other one of the cylinders, while the pair of plates are made to pass between the pair of cylinders by rotating the pair of cylinders.

An eighteenth aspect of the present invention provides the method of mounting the pair of plates for a rotary processing machine according to the seventeenth aspect, in which the one and the other one of the plates are temporarily fixed by overlapping the plates with each other by means of a temporarily-fixing adhesive member in between. The other one of the plates is mounted on the outer circumferential surface of the other one of the cylinders by means of a mounting-purpose adhesive member that has stronger adhesion than the temporarily-fixing adhesive member.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
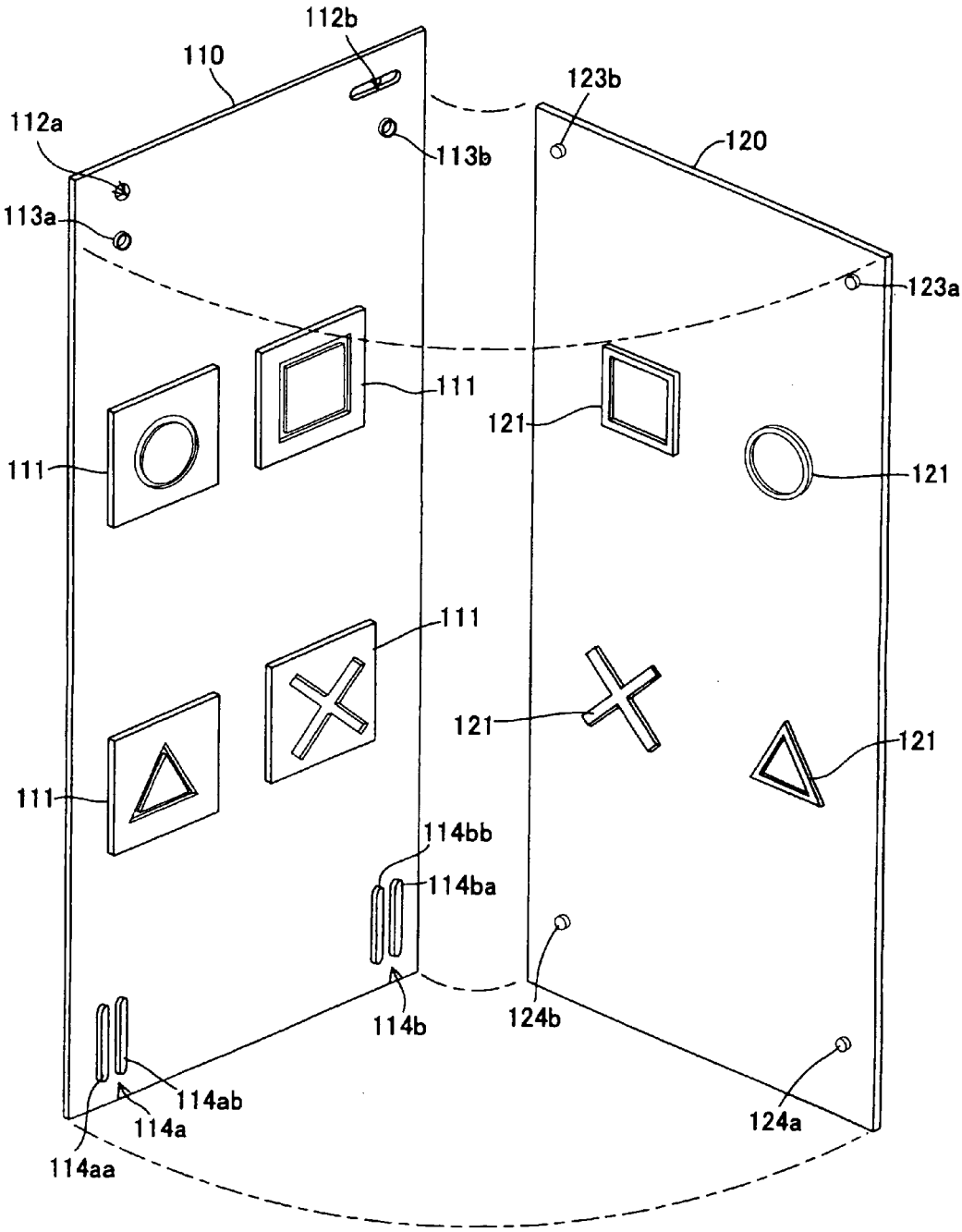
FIG. 1 shows a perspective view of plates for a rotary processing machine according to an embodiment of the present invention.

Plates for a rotary processing machine and a method of mounting the same according to an embodiment of the present invention will be described with reference to FIGS. 1 to 9.

The plates of the rotary processing machine according to this embodiment include a female recessed plate 110 and a male raised plate 120. The female recessed plate 110 includes processing portions 111 in each of which a recessed design is formed, while the male raised plate 120 includes processing portions 121 in each of which a raised design is formed. A pair of cylinders are provided to mount the plates 110 and 120 on their respective outer circumferential surfaces. Passing a paper sheet between the cylinders with the respective plates being mounted thereon allows the paper sheet to have a raised and recessed finish. Each of the plates 110 and 120 is planar and flexible. Each of the plates 110 and 120 is a planar body that is capable of being curved along the outer circumferential surface of a cylinder. Examples of such a planar body include a board and a sheet. Here, the female recessed plate 110 is made of board, to be more specific, made of a metal board, while the male raised plate 120 is made of a sheet, to be more specific, made of a photo-sensitive resin sheet. As will be described later, when the plates 110 and 120 are mounted on the respective cylinders, the plates 110 and 120 are overlapped with each other and curved along the outer circumferential surface of one of the cylinders.

Figure 2:
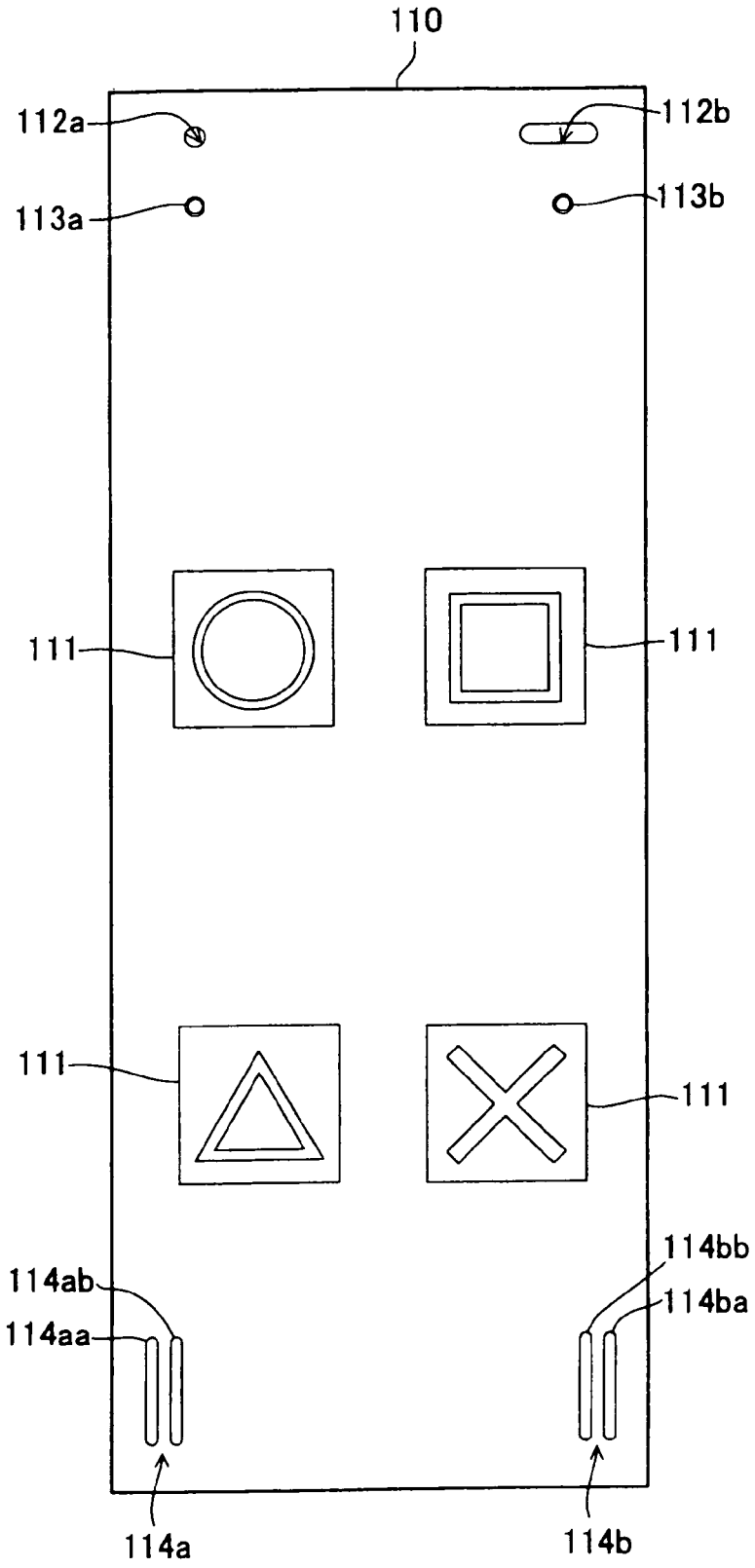
FIG. 2 shows a plan view of a female recessed plate of FIG. 1.

Now, refer to FIGS. 1 and 2. Note that in the following descriptions the direction in which each of the plates 110 and 120 is mounted on the cylinder is referred to as the mount direction. In the female recessed plate 110, a circular-hole mount reference portion 112*a* is formed on the front-end side in the mount direction of the plate 110 (on the gripper side, i.e., on the top side in FIGS. 1 and 2) and on one side in the width direction of the plate 110 (on the left-hand side in FIGS. 1 and 2). In addition, another mount reference portion 112*b* is formed also on the front-end side of the plate 110, but on the other side in the width direction of the plate 110 (on the right-hand side in FIGS. 1 and 2). The mount reference portion 112*b* has a long-hole shape with its longitudinal side being aligned in the width direction of the plate 110. In the plate 110, fitting portions 113*a* and 113*b* each of which has a tubular protruding shape are formed respectively at the rear side of the mount reference portions 112*a* and 112*b*. Moreover, in the plate 110, guide portions 114*a* and 114*b* are formed on the rear-end side in the mount direction of the plate 110 (on the tail side, i.e., on the bottom side in FIGS. 1 and 2) and on the respective sides in the width direction of the plate 110. The guide portion 114*a* includes a pair of guide protrusions 114*aa* and 114*ab* each of which has a shape with its longitudinal side being aligned in the mount direction of the plate 110. The guide protrusions 114*aa* and 114*ab* are arranged side by side with each other, with a predetermined distance left in between, in the width direction of the plate 110. Likewise, the guide portion 114*b* includes guide protrusions 114*ba* and 114*bb* with similar shapes and arranged in a similar manner to their counterparts, that is, guide protrusions 114*aa* and 114*ab*.

Figure 3:
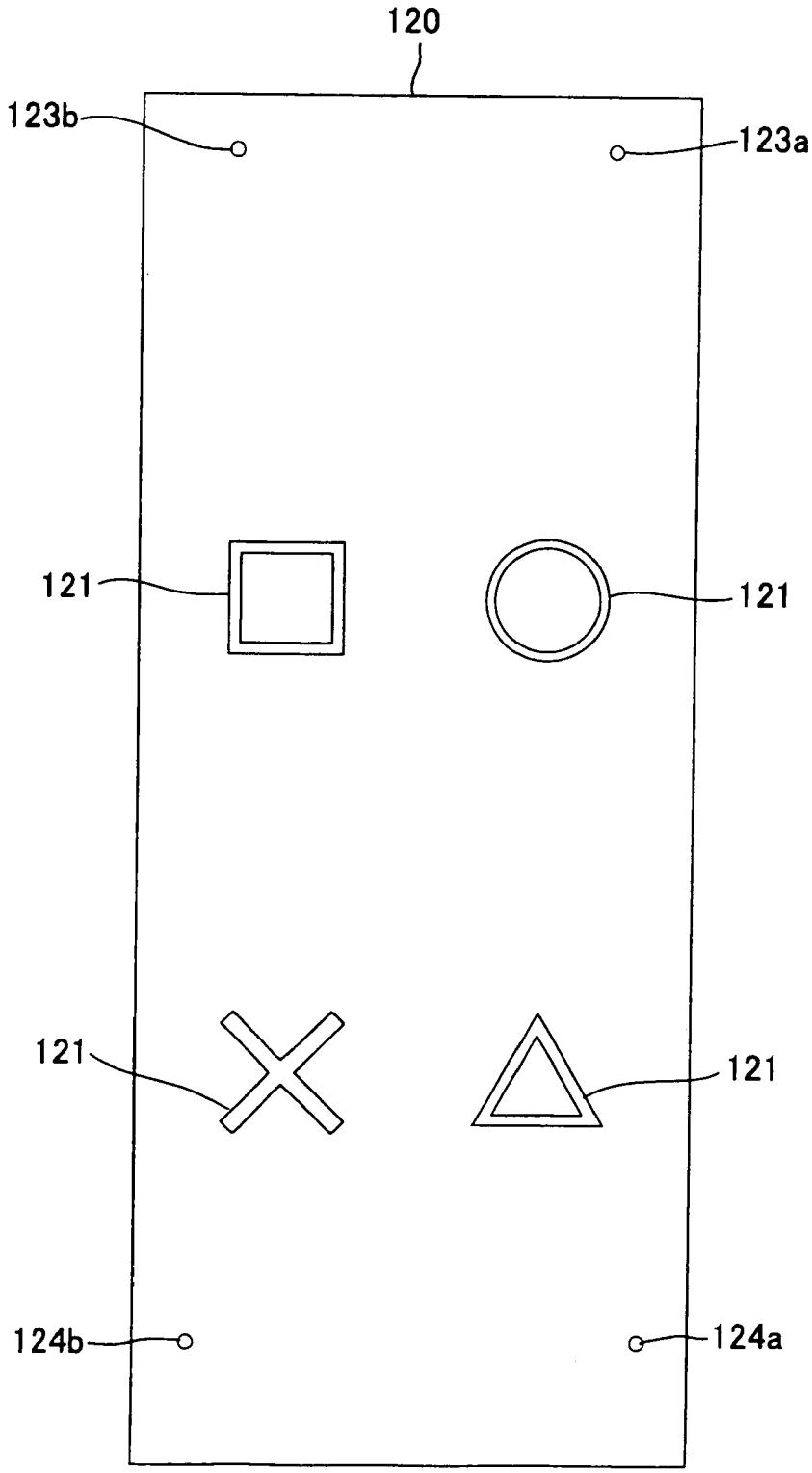
FIG. 3 shows a plan view of a male raised plate of FIG. 1.

Now, refer to FIGS. 1 and 3. In the male raised plate 120, columnar fitting protrusions 123*a* and 123*b* are formed on the front-end side in the mount direction of the plate 120 (on the gripper side, i.e., on the top side in FIGS. 1 and 3). The columnar fitting protrusions 123*a* and 123*b* are formed on the respective sides of the plate 120 in the width direction of the plate 120 so as to correspond to and be fitted into the fitting portions 113*a* and 113*b* of the female recessed plate 110, respectively. Additionally, in the male raised plate 120, columnar guiding protrusions 124*a* and 124*b* are formed on the rear-end side in the mount direction of the plate 120 (on the tail side, i.e., on the bottom side in FIGS. 1 and 3) and on the respective sides of the plate 120 in the width direction of the plate 120. The guiding protrusion 124*a* is inserted between the guiding protrusions 114*aa* and 114*ab* of the guiding portion 114*a*, while the guiding protrusion 124*b* is inserted between the guiding protrusions 114*ba* and 114*bb* of the guiding portion 114*b*.

Now suppose that the plates 110 and 120 are overlapped with each other so as to make the processing portions 111 correspond to the respective processing portions 121. Then, the fitting protrusions 123*a* and 123*b* are fitted into the respective fitting portions 113*a* and 113*b*. Accordingly, the movement of the fitting protrusions 123*a* and 123*b* is restricted (see FIGS. 4 and 5) in the width direction of the plates 110 and 120 (in the right-and-left direction in FIGS. 2 and 3), as well as in the mount direction of the plates 110 and 120 (in the up-and-down direction in FIGS. 2 and 3). Concurrently, the guiding protrusion 124*a* is inserted between the pair of the guide protrusions 114*aa* and 114*ab* of the guiding portion 114*a*, while the guiding protrusion 124*b* is inserted between the pair of the guide protrusions 114*ba* and 114*bb* of the guiding portion 114*b*. Accordingly, the guiding portion 114*a* sandwiches the guiding protrusion 124*a* from both sides thereof in the width direction of the plates 110 and 120, while the guiding portion 114*b* sandwiches the guiding protrusion 124*b* from both sides thereof in the width direction of the plates 110 and 120. As a result, the guiding protrusions 124*a* and 124*b* guided by the guide portions 114*a* and 114*b* are allowed to move independently of the respective guide portions 114*a* and 114*b* only in the mount direction of the plates 110 and 120.

Accordingly, the plates 110 and 120 engage with each other, while the plates 110 and 120 are overlapped with each other with the processing portions 111 corresponding to the respective processing portions 121. Such engagement restricts the relative movement of the plates 110 and 120 to each other on the front-end side in the mount direction of the plates 110 and 120 (on the top side in FIGS. 1 to 3). In the meanwhile, on the rear-side in the mount direction of the plates 110 and 120 (on the bottom side in FIGS. 1 to 3), such engagement restricts the relative movement of the plates 110 and 120 to each other in the width direction of the plates 110 and 120 (in the right-and-left direction in FIGS. 2 and 3), but allows the relative movement of the plates 110 and 120 to each other in the mount direction of the plates 110 and 120 (in the up-and-down direction in FIGS. 1 to 3).

Figure 4:
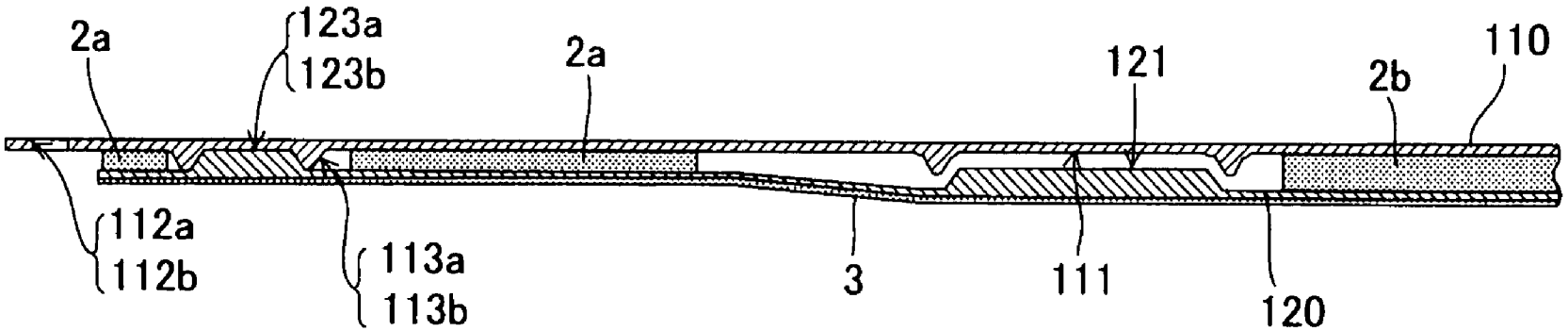
FIG. 4 shows a sectional view of the plates of FIG. 1 at the time when the plates are mounted on respective cylinders of the rotary processing machine.
Figure 5:
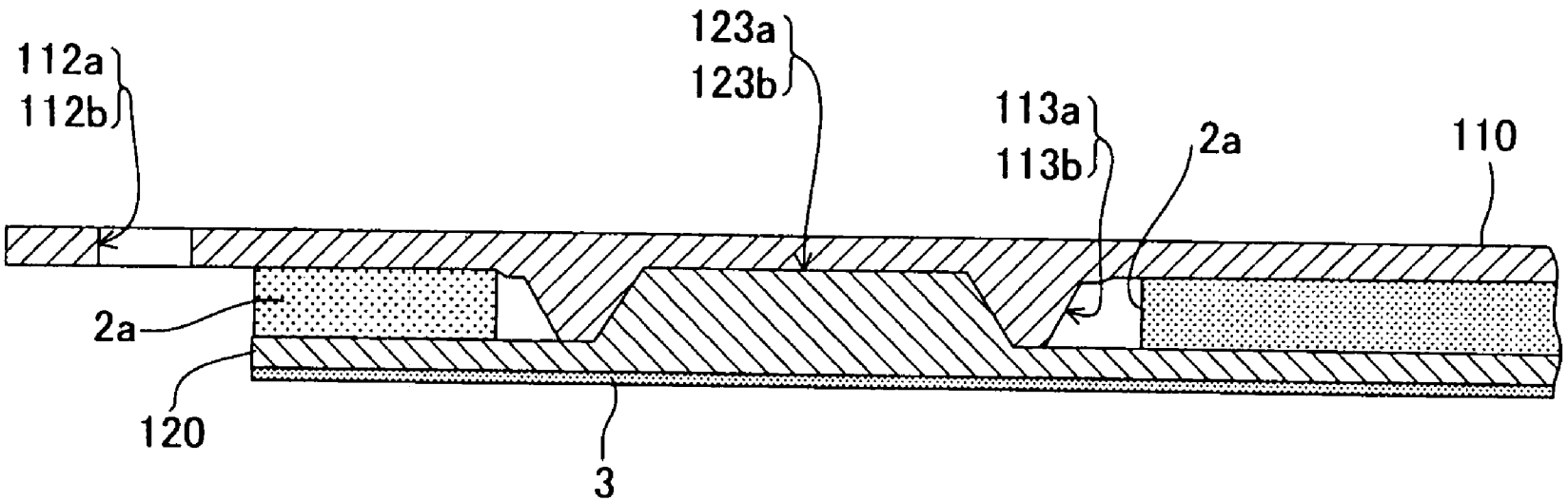
FIG. 5 shows an enlarged view showing a principal portion extracted from FIG. 4.

Now, refer to FIGS. 4 and 5. Each of the fitting protrusions 123*a* and 123*b* of the male raised plate 120 has a tapered outer circumferential surface with its tip end having a smaller diameter than the diameter of its base portion. In the meanwhile, each of the fitting portions 113*a* and 113*b* of the female recessed plate 110 has a tapered inner circumferential surface that has a shape corresponding to the tapered outer circumferential surface of each of the fitting protrusions 123*a* and 123*b*. To put it in other way, in the tapered inner circumferential surface of each of the fitting portion 113*a* and 113*b*, the diameter of the side from which the corresponding one of the fitting protrusions 123*a* and 123*b* of the male raised plate 120 enters is larger than the diameter of the opposite side.

In addition, each of the guiding protrusions 124*a* and 124*b* of the male raised plate 120 has a tapered outer circumferential surface with its tip end having a smaller diameter than the diameter of its base portion. Among the faces of the pair of guide protrusions 114*aa* and 114*ab* of the guide portion 114*a* provided in the female recessed plate 110, a face of the guide protrusion 114*aa* and a face of guide protrusion 114*ab* that are opposed to each other are tapered so as to form a shape corresponding to the tapered outer circumferential surface of the guiding protrusion 124*a* of the male raised plate 120. To put it in other way, the tapered shape formed in the guide portion 114*a* has a larger diameter on the side from which the guiding protrusions 124*a* of the male raised plate 120 enters than the diameter on the opposite side. Likewise, among the faces of the pair of guide protrusions 114*ba* and 114*bb* of the guide portion 114*b* provided in the female recessed plate 110, a face of the guide protrusion 114*ba* and a face of guide protrusion 114*bb* that are opposed to each other are tapered so as to form a shape corresponding to the tapered outer circumferential surface of the guiding protrusion 124*b* of the male raised plate 120. To put it in other way, the tapered shape formed in the guide portion 114*b* has a larger diameter on the side from which the guiding protrusions 124*b* of the male raised plate 120 enters than the diameter on the opposite side.

The female recessed plate 110 can be fabricated using a single processing machine by a batch operation in which the processing portions 111, the mount reference portions 112*a* and 112*b*, the fitting portions 113*a* and 113*b*, and the guide portions 114*a* and 114*b* are formed altogether in a metal board. The male raised plate 120, on the other hand, can be fabricated using an exposure apparatus by a batch operation in which the processing portions 121, the fitting protrusions 123*a* and 123*b*, and the guiding protrusions 124*a* and 124*b* are formed altogether in a photo-sensitive resin sheet.

In this embodiment, the fitting portions 113*a* and 113*b*, the fitting protrusions 123*a* and 123*b*, and the like are included in a fitting engagement portion. In addition, the guide portions 114*a* and 114*b*, the guiding protrusions 124*a* and 124*b*, and the like are included in a guide engagement portion. Moreover, the fitting engagement portion, the guide engagement portion, and the like are included in an engagement portion.

Now, descriptions will be given as to the rotary processing machine on which the plates 110 and 120 are mounted.

Figure 6:
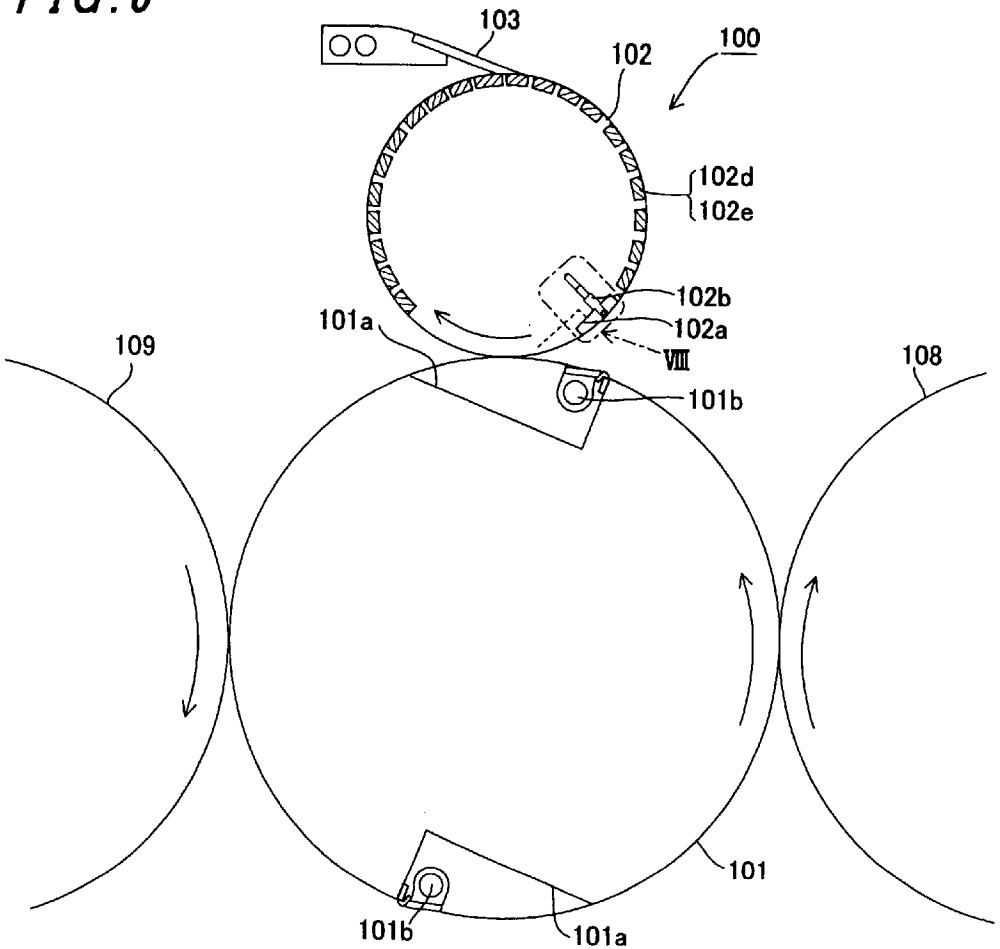
FIG. 6 shows a schematic configuration view of a rotary processing machine on which the plates of FIG. 1 are mounted according to an embodiment of the present invention.

Refer to FIG. 6. A transfer cylinder 108 is in contact with an impression cylinder (transport cylinder) 101. The impression cylinder 101 is a support cylinder for supporting a paper sheet, which is an example of a sheet, on its outer circumferential surface. To this end, notch portions 101*a* is formed in the outer circumferential surface of the impression cylinder 101, and a gripper device 101*b* that holds the front-end side of the paper sheet is installed in each of the notch portions 101*a*. By means of the transfer cylinder 108, the paper sheet is passed from a feeder apparatus, which is sheet supply means, to the impression cylinder 101.

Figure 7:
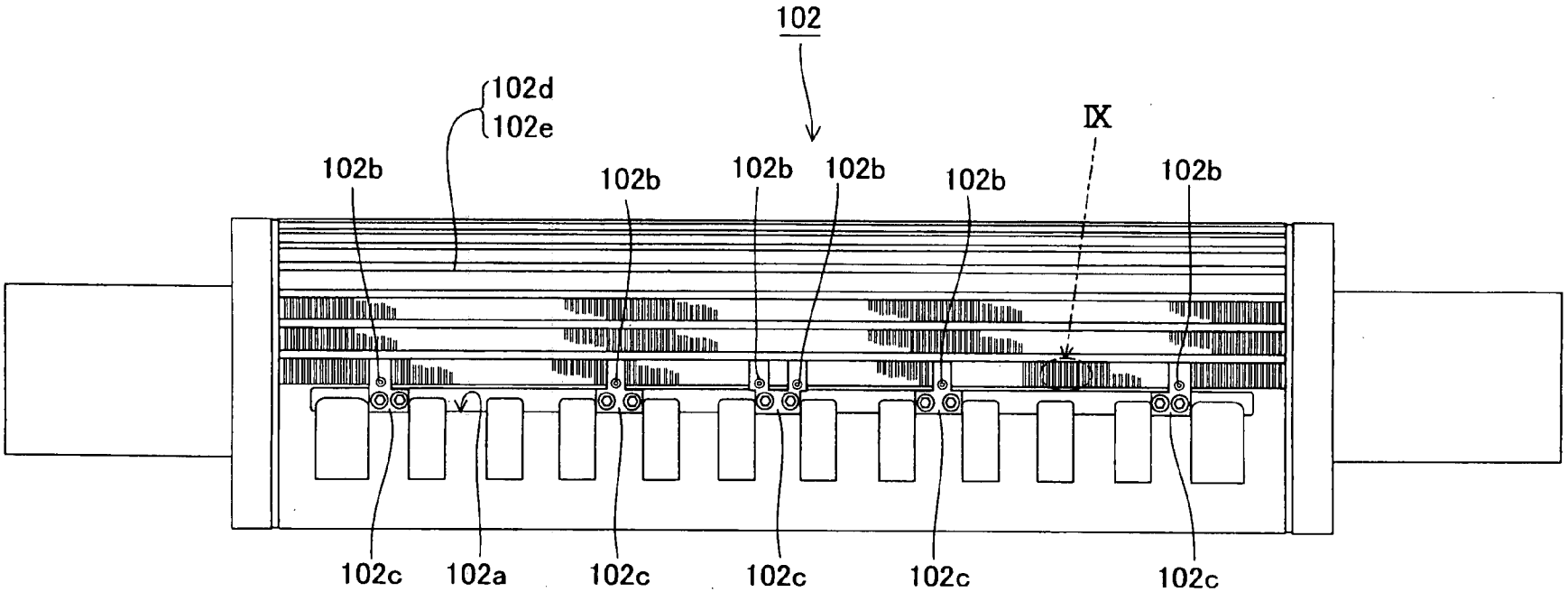
FIG. 7 shows a plan view of a magnet cylinder shown in FIG. 6.
Figure 8:
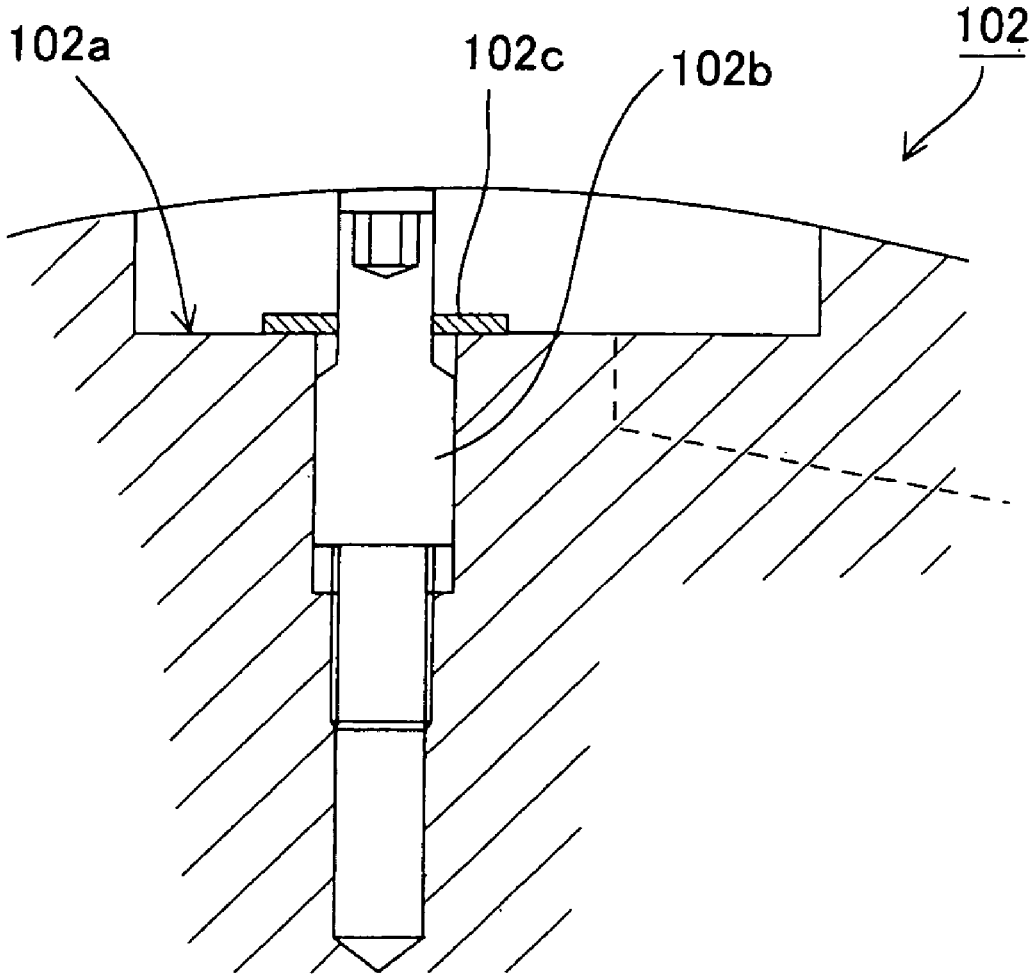
FIG. 8 shows an enlarged view illustrated by extracting a portion indicated by the arrow VIII in FIG. 6.
Figure 9:
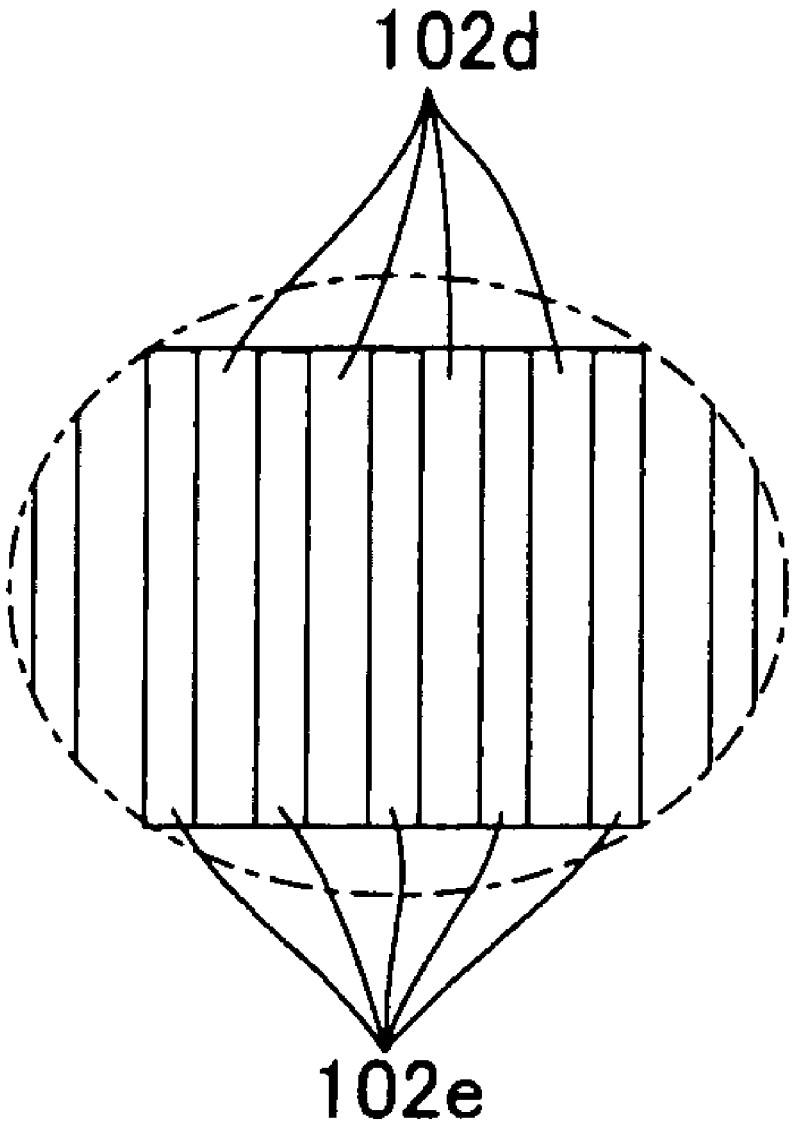
FIG. 9 shows an enlarged view illustrated by extracting a portion indicated by the arrow IX in FIG. 7.
Figure 10:
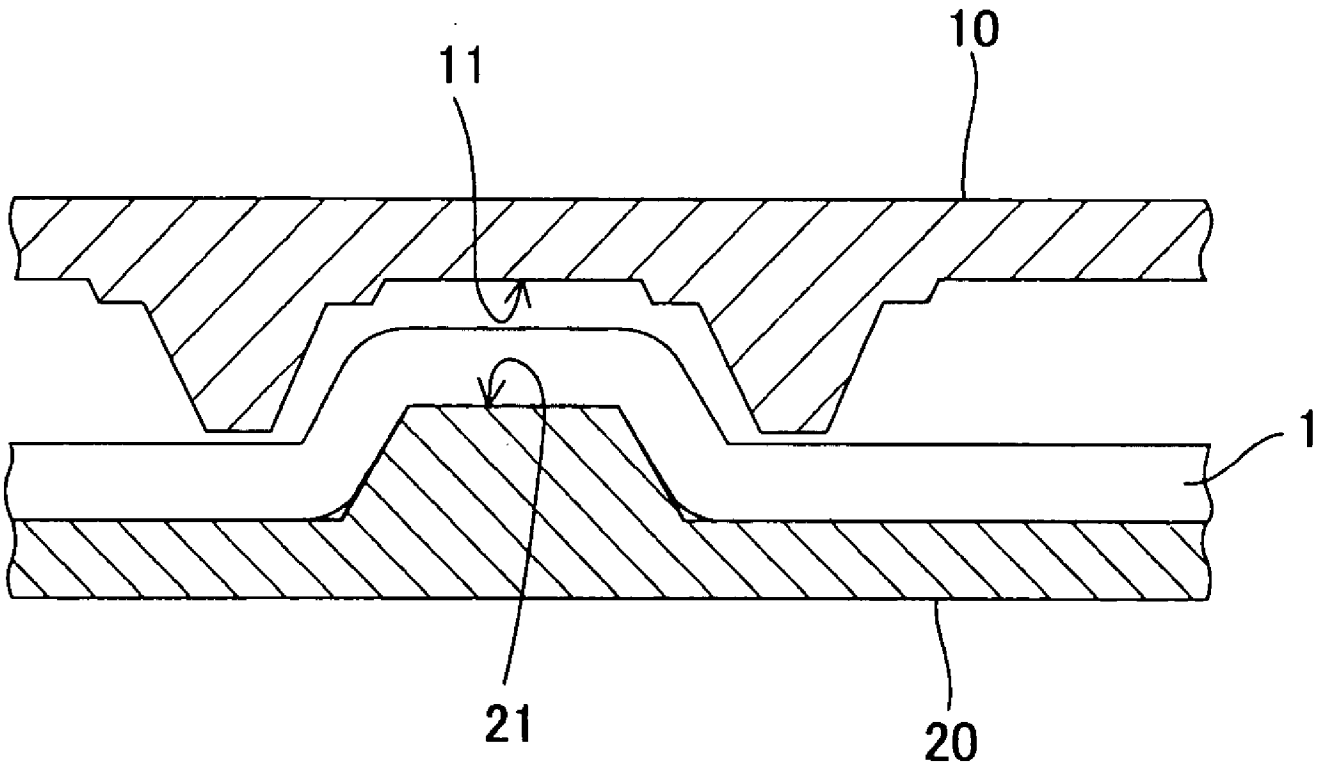
FIG. 10 shows an explanatory view for the processing of embossing.

A magnet cylinder 102 is disposed so as to oppose the impression cylinder 101 at a position on the more downstream-side in the transporting direction of the paper sheet than the position where the transfer cylinder 108 opposes the impression cylinder 101. Now, refer to FIGS. 6 to 8. A notch portion 102*a* is formed in the outer circumference of the magnet cylinder 102. Provided inside the magnet cylinder 102 are plural reference pins 102*b*, each of which has its threaded portion screwed into the magnet cylinder 102 towards the shaft center. The plural reference pins 102*b* are disposed, at predetermined intervals, all along the axial direction of the magnet cylinder 102. Here, stopper plates 102*c* are provided to help the fastening of the respective reference pins 102*b* to the magnet cylinder 102. In addition, as FIGS. 6, 7 and 9 show, a large number of plate-shaped magnets 102*d* and a large number of plate-shaped metal yokes 102*e* are laid alternately all along the effective area of the outer circumferential surface of the magnet cylinder 102.

FIG. 6 also shows a guide table 103 provided at a position more upstream side in the rotational direction of the magnet cylinder 102 than the position where the magnet cylinder 102 is in contact with the impression cylinder 101. The guide table 103 guides the female recessed plate 110 on top of which the male raised plate 1-20 is laid, and the female recessed plate 110 thus guided is led to the outer circumferential surface of the magnet cylinder 102.

A transfer cylinder 109 is in contact with the impression cylinder 101 at a position more downstream side in the transporting direction of the paper sheet than the position where the magnet cylinder 102 is in contact with the impression cylinder 101. By means of the transfer cylinder 109, the paper sheet is passed from the impression cylinder 101 to a paper discharge apparatus, which is a discharge apparatus.

It should be noted that, in this embodiment, the impression cylinder 101 and the magnet cylinder 102 are the pair of cylinders on which the plates 110 and 120 are mounted respectively.

Now, descriptions will be given as to a method of mounting the plate 110 and 120 on a rotary processing machine 100.

Firstly, the plates 110 and 120 are made to oppose each other so that the processing portion 111, the fitting portions 113*a* and 113*b*, and the guide portions 114*a* and 114*b* of the female recessed plate 110 are made to correspond respectively to the processing portion 121, the fitting protrusions 123*a* and 123*b*, and the guiding protrusions 124*a* and 124*b* of the male raised plate 120. A temporarily-fixing two-sided adhesive tape 2*a* is disposed around the fitting portions 113*a* and 113*b* coupled respectively to the fitting protrusions 123*a* and 123*b* as well as around the guide portions 114*a* and 114*b* coupled respectively to the guiding protrusions 124*a* and 124*b*. The temporarily-fixing two-sided adhesive tape 2*a* used here is a relatively-thin temporarily-fixing adhesive member (the temporarily-fixing two-sided adhesive tape 2*a* has a thickness that allows the fitting protrusions 123*a* and 123*b* as well as the guiding protrusions 124*a* and 124*b* to engage, in a closely contact state, respectively with the fitting portions 113*a* and 113*b* as well as the guide portions 114*a* and 114*b*). In addition, a temporarily-fixing two-sided adhesive tape 2*b* is disposed around each of the coupled processing portions 111 and 112. The temporarily-fixing two-sided adhesive tape 2*b* used here is a relatively-thick temporarily-fixing adhesive member, and the material and thickness of the tape 2*b* are determined so that the tape 2*b* can absorb any relative shift of the plates 110 and 120 from each other. Subsequently, the fitting protrusions 123*a* and 123*b* are fitted into the respective fitting portions 113*a* and 113*b*. Concurrently, the guiding protrusions 124*a* and 124*b* are inserted into the respective guide portions 114*a* and 114*b*. In this event, the guiding protrusion 124*a* is sandwiched by the guide portion 114*a* from the two sides in the width direction, while the guiding protrusion 124*b* is sandwiched by the guide portion 114*b* in the same way. The plates 110 and 120 can be made closely in contact with each other by the procedures described above. In addition, the relative positions of the plates 110 and 120 can be fixed temporarily with the temporarily-fixing two-sided adhesive tapes 2*a* and 2*b*. After that, a mounting-purpose two-sided adhesive tape 3 is attached onto the back-side surface of the male raised plate 120 (see FIGS. 4 and 5). The mounting-purpose two-sided adhesive tape 3 has stronger adhesion than that of the temporarily-fixing two-sided adhesive tapes 2*a* and 2*b*.

Subsequently, the plates 110 and 120 are placed on the guide table 103. At this time, the side of the mount reference portions 112*a* and 112*b* formed in the female recessed plate 110 is directed to the front-end side of the guide table 103 (to the right-hand side in FIG. 6) of the rotary processing machine 100. In addition, the back-side surface of the female recessed plate 110 is made to oppose the guide table 103. Then, the relative position of the female recessed plate 110 to the magnet cylinder 102 is determined by engaging the mount reference portions 112*a* and 112*b* formed in the female recessed plate 110 with the corresponding ones of the reference pins 102*b* that are provided in the magnet cylinder 102.

Here, the impression cylinder 101 and the magnet cylinder 102 are rotated in the mount direction of the plates 110 and 120 (in the direction indicated by an arrow in FIG. 6). As the magnet cylinder 102 rotates, the female recessed plate 110 is pulled out from the top of the guide table 103 by the reference pins 102*b*.

The plates 110 and 120 used here are flexible planar bodies that are capable of being curved along the outer circumferential surface of the magnet cylinder 102, and the female recessed plate 110 is made of a metal board. Accordingly, as the female recessed plate 110 is curved along the outer circumferential surface of the magnet cylinder 102, the female recessed plate 110 is magnetically attached and fixed to the outer circumferential surface of the magnet cylinder 102 by the magnets 102*d* provided in the magnet cylinder 102. In the meanwhile, the male raised plate 120 that has been laid on the female recessed plate 110 by means of the temporarily-fixing two-sided adhesive tapes 2*a* and 2*b* is also curved together with the female recessed plate 110.

Here, the radius of curvature of the female recessed plate 110 differs slightly from that of the male raised plate 120. For this reason, the female recessed plate 110 and the male raised plate 120 become slightly shifted from each other in the mount direction of the female recessed plate 110, that is, in the rotational direction of the magnet cylinder 102. The relative movement of these plates 110 and 120 to each other is restricted on the front-end side of these plates 110 and 120 in the mount direction of these plates 110 and 120 by the effect that is brought about by the above-described engagement of the fitting portions 113*a* and 113*b* of the female recessed plate 110 with the respective fitting protrusions 123*a* and 123*b* of the male raised plate 120. Accordingly, the shift amount increases towards the rear-end side of the plates 110 and 120 in the mount direction of the plates 110 and 120.

Nevertheless, the male raised plate 120 stretches in the mount direction of the plates 110 and 120, and the temporarily-fixing two-sided adhesive tapes 2*a* and 2*b* are slightly elastic. As a result of these factors and by the effect brought about by the engagement of the guide portions 114*a* and 114*b* of the female recessed plate 110 with the guiding raised portions 124*a* and 124*b* of the male raised plate 120, the male raised plate 120 is allowed to move relative to the female recessed plate 110 in the mount direction of the plates 110 and 120 on the rear side of the plates 110 and 120 in the mount direction of the plates 110 and 120, while the relative movement of the male raised plate 120 to the female recessed plate 110 in the width direction of the plates 110 and 120 is restricted.

Accordingly, the shifting that takes place between the plates 110 and 120 is absorbed on the rear side of the plates 110 and 120 in the mount direction of the plates 110 and 120. As a consequence, the plates 110 and 120 can be curved while the plates 110 and 120 continue to be overlapped with each other and while the relative positions of the processing portions 111 and 121 to each other are maintained appropriately.

Then, as the impression cylinder 101 and the magnet cylinder 102 rotate further, the plates 110 and 120 reach the position where the magnet cylinder 102 opposes the impression cylinder 101. By this moment, the mounting-purpose two-sided adhesive tape 3 attached on the back-side surface of the male raised plate 120 has adhered to the outer circumferential surface of the impression cylinder 101. Accordingly, the male raised plate 120 gets gradually peeled off from the female recessed plate 110 against the adhesion of the temporarily-fixing two-sided adhesive tapes 2*a* and 2*b*, and comes to be mounted on the outer circumferential surface of the impression cylinder 101.

Consequently, while the female recessed plate 110 is mounted on the outer circumferential surface of the magnet cylinder 102, the male raised plate 120 is mounted on the outer circumferential surface of the impression cylinder 101. Then, as the last step of the mounting operation, the temporarily-fixing two-sided adhesive tapes 2*a* and 2*b* are removed from the respective surfaces of the plates 110 and 120, and the protrusions 123*a*, 123*b*, 124*a*, and 124*b* of the male raised plate 120 are cut and removed by use of a cutter or the like. Thus, the mounting operation is finished.

The rotary processing machine 100 on which the plates 110 and 120 have been mounted in the above-described way performs, on a series of paper sheets that are transported one after another, emboss processing in the following way. By rotating the cylinders 101, 108, and 109 as well as the magnet cylinder 102, a paper sheet fed from the feeder apparatus is passed from the transfer cylinder 108 to the impression cylinder 101. Then, at the position where the impression cylinder 101 and the magnet cylinder 102 oppose each other, the processing portions 111 and 112 formed in the respective plates 110 and 120 cooperate with each other and give the paper sheet a raised and recessed finish (emboss processing) corresponding to the designs formed in the processing portions 111 and 121. After that, the paper sheet is passed from the impression cylinder 101 to the transfer cylinder 109, and then is discharged to the paper discharge apparatus.

As has been described above, the rotary processing machine 100 used in this embodiment has the following configuration. The fitting portions 113*a* and 113*b* as well as the guide portions 114*a* and 114*b* are formed in the female recessed plate 110, while the fitting protrusions 123*a* and 123*b* as well as the guiding protrusions 124*a* and 124*b* are formed in the male raised plate 120. The plates 110 and 120 are overlapped with each other so that the fitting portions 113*a* and 113*b* can engage respectively with the fitting protrusions 123*a* and 123*b*, and so that the guide portions 114*a* and 114*b* can engage respectively with the guiding protrusions 124*a* and 124*b*. Thus the plates 110 and 120 are temporarily fixed to each other by use of the temporarily-fixing two-sided adhesive tapes 2*a* and 2*b*. Accordingly, while the relative movement of the plates 110 and 120 to each other in the width direction of the plates 110 and 120 is restricted, the relative movement of the plates 110 and 120 to each other in the mount direction of the plates 110 and 120 is allowed on the rear side of the plates 110 and 120 in a direction in which the plates 110 and 120 are mounted on the magnet cylinder 102.

The above-described configuration has the following effects. The setting of the relative positions of the plates 110 and 120 respectively to the magnet cylinder 102 and the impression cylinder 101, that is, the setting of the relative positions of the plates 110 and 120 to each other, and the setting of the relative positions of the plates 110 and 120 to the paper sheet can be done with precision by the following procedure. Firstly, the female recessed plate 110 is positioned with respect to the magnet cylinder 120 and is then mounted on the magnet cylinder 120. While the female recessed plate 110 and the magnet cylinder 102 are kept in this state, the magnet cylinder 102 and the impression cylinder 101 are rotated. As the male raised plate 120 is gradually separated from the female recessed plate 110, the male raised plate 120 comes to be mounted on the impression cylinder 101 by means of the mounting-purpose two-sided adhesive tape 3.

As a consequence, according to this embodiment, it is no longer necessary to carry out the test processing and the like that would otherwise be necessary to finely adjusting the relative positions of the plates 110 and 120. The elimination of the test processing in turn improves the work efficiency to a large extent.

In addition, the outer circumferential surface of each of the fitting protrusions 123*a* and 123*b* of the male raised plate 120 has a tapered shape with its tip end having a smaller diameter than the diameter of its base portion, and so does the outer circumferential surface of each of the guiding protrusions 124*a* and 124*b*. In the meanwhile, the inner circumferential surface of each of the fitting portions 113*a* and 113*b* of the female recessed plate 110 has a tapered shape that has a larger diameter on its side from which the corresponding one of the protrusions 123*a* and 123*b* of the male raised plate 120 enters than the diameter on the opposite side. In addition, among the faces of the pair of guide protrusions 114*aa* and 114*ab* of the guide portion 114*a* provided in the female recessed plate 110, a face of the guide protrusion 114*aa* and a face of guide protrusion 114*ab* that are opposed to each other form a tapered shape that has a larger diameter on the side from which the guiding protrusion 124*a* of the male raised plate 120 enters than the diameter on the opposite side. Likewise, among the faces of the pair of guide protrusions 114*ba* and 114*bb* of the guide portion 114*b* provided in the female recessed plate 110, a face of the guide protrusion 114*ba* and a face of guide protrusion 114*bb* that are opposed to each other form a similar tapered shape that has a larger diameter on the side from which the guiding protrusion 124*b* of the male raised plate 120 enters than the diameter on the opposite side. Accordingly, the engagement of these protrusions and portions can be accomplished with ease. In the meanwhile, the restriction on the relative movement of the plates 110 and 120 to each other can be ensured once the engagement has been accomplished. As a result, the relative positions of the plates 110 and 120 can be determined with both high precision and ease.

In addition, the areas around the fitting portion 113*a* and around the fitting portion 113*b* are attached respectively to the areas around the fitting protrusion 123*a* and around the fitting protrusion 123*b* by means of the relatively-thin temporarily-fixing two-sided adhesive tape 2*a*. Likewise, the areas around the guide portion 114*a* and around the guide portion 114*b* are attached respectively to the areas around the guiding protrusion 124*a* and around the guiding protrusion 124*b* by means of the relatively-thin temporarily-fixing two-sided adhesive tape 2*a*. Moreover, the areas around the processing portions 111 are attached respectively to the areas around the processing portions 121 by means of the relatively-thick temporarily-fixing two-sided adhesive tape 2*b*. Accordingly, the engagement of the fitting portions 113*a* and 113*b* with the respective fitting protrusions 123*a* and 123*b* is ensured. So is the engagement of the guide portions 114*a* and 114*b* with the respective guiding protrusions 124*a* and 124*b*. As a consequence, the setting of the relative positions of the plates 110 and 120 is ensured with precision. In addition, when the magnet cylinder 102 is in contact with the impression cylinder 101, the mounting-purpose two-sided adhesive tape 3 attached on the back-side surface of the male raised plate 120 can be pressed firmly onto the outer circumferential surface of the impression cylinder 101. Accordingly, the mounting of the male raised plate 120 on the impression cylinder 101 can be ensured.

In addition, the female recessed plate 110 can be fabricated using a single processing machine by a batch operation in which the processing portions 111, the mount reference portions 112*a* and 112*b*, the fitting portions 113*a* and 113*b*, and the guide portions 114*a* and 114*b* are formed altogether in a metal board. The male raised plate 120, on the other hand, can be fabricated using an exposure apparatus by a batch operation in which the processing portions 121, the fitting protrusions 123*a* and 123*b*, and the guiding protrusions 124*a* and 124*b* are formed altogether in a photo-sensitive resin sheet. Accordingly, the positions of the above-mentioned protrusions and portions within the plates 110 and 120 can be determined with high precision and ease. Consequently, the relative positions of the plates 110 and 120 to each other as well as the relative positions of the plates 110 and 120 to the paper sheet can be set with higher precision.

In addition, once the mounting of the plates 110 and 120 on the respective cylinders 102 and 101 is completed and the protrusions 123*a*, 123*b*, 124*a*, and 124*b* of the male raised plate 120 become no longer necessary, the protrusions 123*a*, 123*b*, 124*a*, and 124*b* can be cut and removed by use of a cutter or the like. Accordingly, unnecessary raised and recessed finish that would otherwise be given to the paper sheet can be avoided with a simple measure.

Incidentally, in this embodiment, the female recessed plate 110 and the male raised plate 120 are firstly overlapped with each other, then the female recessed plate 110 is mounted on the magnet cylinder 102 of the rotary processing machine 100, and, after that, the male raised plate 120 is mounted on the impression cylinder 101. In a possible alternative embodiment, for example, the female recessed plate 110 is firstly mounted on the magnet cylinder 102 of the rotary processing machine 100, then the male raised plate 120 is laid on top of the female recessed plate 110, and, after that, the male raised plate 120 is mounted on the impression cylinder 101.

Moreover, in this embodiment, the mount reference portions 112*a* and 112*b* are formed in the female recessed plate 110 made of a metal board, and the mounting-purpose two-sided adhesive tape 3 is attached on the back-side surface of the male raised plate 120 made of a photo-sensitive resin sheet. In addition, when the female recessed plate 110 is mounted on the magnet cylinder 102, the position of the female recessed plate 110 is determined by engaging the female recessed plate 110 with the reference pins 102*b* of the magnet cylinder 102. The mounting of the male raised plate 120 on the impression cylinder 101 is achieved by the adhesion of the male raised plate 120 and the impression cylinder 101. In a possible alternative embodiment, for example, a male raised plate having a mount reference portion is made of a metal board, and a female recessed plate without a mount reference portion is made of a photo-sensitive resin sheet. The mounting-purpose two-sided adhesive tape 3 is attached on the back-side surface of the female recessed plate 110. When the male raised plate is mounted on the magnet cylinder 102, the position of the male raised plate is determined by engaging the male raised plate 120 with the reference pins 102*b* of the magnet cylinder 102. The mounting of the female recessed plate 110 on the impression cylinder 101 is achieved by the adhesion of the female recessed plate 110 and the impression cylinder 101.

Moreover, in both of the above-described embodiments, one of the female recessed plate and the male raised plate is made of a metal board, while the other one of the two plates is made of a photo-sensitive resin sheet. In a possible alternative embodiment, both of the female recessed plate and the male raised plate may be made of metal boards, or, still alternatively, may be made of photo-sensitive resin sheets. When a female recessed plate and a male raised plate both of which are made of metal boards are used, it is preferable that the rotary processing machine have an impression cylinder that is a magnet cylinder. Conversely, when a female recessed plate and a male raised plate both of which are made of photo-sensitive resin sheets are used, it is preferable that the rotary processing machine have a cylinder with an ordinary outer circumferential surface in place of a magnet cylinder. In this case, the mounting of one of the plates on this cylinder with an ordinary outer circumferential surface can be accomplished by means of a mounting-purpose adhesive member.

Moreover, each of the fitting portions 113*a* and 113*b* employed in this embodiment is a tubular protrusion. In a possible alternative embodiment, each fitting portion can be formed as a hole or a groove.

Moreover, in this embodiment, the guide portion 114*a* has the pair of guide protrusions 114*aa* and 114*ab*, while the guide portion 114*b* has the pair of guide protrusions 114*ba* and 114*bb*. In each of the pairs mentioned above, the two guide portions are formed with their longitudinal sides being oriented in the mount direction of the plates 110 and 120, and are arranged side by side with each other with a predetermined distance being left in between, in the width direction of the plates 110 and 120. In a possible alternative embodiment, for example, each guide portion can be formed as a long hole or a long groove that extends with its longitudinal side being oriented in the mount direction of the plates.

Moreover, in this embodiment, two sets of a fitting portion and a fitting protrusion—specifically, a set composed of the fitting portion 113*a* and the fitting protrusion 123*a* as well as another set composed of the fitting portion 113*b* and the fitting protrusion 123*b*—are formed. In addition, two sets of a guide portion and a guiding protrusion—specifically, a set composed of the guide portion 114*a* and the guiding protrusion 124*a* as well as another set composed of the guide portion 114*b* and the guiding protrusion 124*b*—are formed. Alternatively, at least three sets, in total, of a fitting portion and a fitting protrusion as well as of a guide portion and a guiding protrusion are needed to determine the relative positions of the plates with precision and ease. In other words, at least three sets bring about a preferable result.

Moreover, in this embodiment, descriptions are based on a case of a rotary processing machine that performed emboss processing on a paper sheet, but this is not the only case that is suitable for the present embodiment. In a possible alternative embodiment, for example, the present invention is applicable, in a similar way to this embodiment, to plates for a rotary processing machine that performs various kinds of processing, such as embossing and punching, on a sheet including a paper sheet, or on a web.

According to the present invention, when the plates are overlapped with each other, the engagement portions engage with each other so as to restrict the relative movement of the plates in the width direction of the plates, and to allow the relative movement of the plates in the mount direction on the rear side of the plates in the mount direction of the plates on the respective cylinders. Accordingly, the plates are mounted on the respective cylinders in a state where the other one of the plates is overlapped with the one of the plates with their respective positions being determined by the engagement of the other one of the plates with the one of the plates by means of the engagement portions. Consequently, relative positional relations of the plates can be maintained appropriately during the mounting of the plates on the respective cylinders. For this reason, the plates are mounted with higher precision, and it is no longer necessary to carry out the test processing and the like that would otherwise be necessary to finely adjusting the relative positions of the plates. The elimination of the test processing in turn improves the work efficiency to a large extent.

The plates for a rotary processing machine and the method of mounting the same according to the present invention allow the plates to be mounted on the respective cylinders with the relative positions of the plates to the respective cylinders being maintained. To put it in other way, relative positional relations of the plates can be maintained appropriately during the mounting of the plates on the respective cylinders. Accordingly, the plates are mounted with higher precision, and it is no longer necessary to carry out the test processing and the like that would otherwise be necessary to finely adjusting the relative positions of the plates. The elimination of the test processing in turn improves the work efficiency to a large extent. For these reasons, the present invention is extremely useful in various industries involving the above-mentioned kinds of processing.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pair of plates for a rotary processing machine that are mounted respectively on outer circumferential surfaces of a pair of cylinders, each of the plates having a processing portion used for performing processing on any one of a sheet and a-web that is passed between the cylinders, the pair of plates comprising:

paired engagement portions formed respectively in the pair of plates, the engagement portions engaging with each other when the pair of plates are overlapped with each other, the engaging of the engagement portions restricting a relative movement of the pair of plates on a front side of the pair of plates in a mount direction in which the pair of plates are mounted on respective cylinders, and the engaging of the engagement portions restricting relative movement of the pair of plates in a width direction of the pair of plates on a rear side of the pair of plates in a mount direction, and allowing relative movement of the pair of plates in the mount direction on the rear side.

2. The pair of plates for a rotary processing machine according to claim 1, wherein the engagement portions comprises guide engagement portions including:

a guiding protrusion formed so as to protrude on a rear-end side of one of the pair of plates in the mount direction; and a guide portion formed on a rear-end side of the other one of the pair of plates in the mount direction, the guide portion engaging with the guiding protrusion so as to guide a movement of the guiding protrusion only in the mount direction.

3. The pair of plates for a rotary processing machine according to claim 2, wherein the engagement portions comprises fitting engagement portions including:

a fitting protrusion formed so as to protrude on a front-end side of one of the pair of plates in the mount direction; and a fitting portion formed on a front-end side of the other one of the pair of plates in the mount direction, the fitting portion being fitted to the fitting protrusion so as to restrict a movement of the fitting protrusion both in the width direction and in the mount direction.

4. The pair of plates for a rotary processing machine according to claim 3, wherein the fitting portion of the fitting engagement portions is any one of a hole, a groove, and a protrusion.

5. The pair of plates for a rotary processing machine according to claim 4, wherein the fitting protrusion of the fitting engagement portions includes a tapered surface with a size thereof being gradually decreasing towards a tip-end side.

6. The pair of plates for a rotary processing machine according to claim 4, wherein the fitting portion of the fitting engagement portions includes a tapered surface with a size thereof being gradually increasing towards a side from which the fitting protrusion enters.

7. The pair of plates for a rotary processing machine according to claim 3, wherein the guide engagement portions include at least one set of the guiding protrusion and the guide portion, the fitting engagement portions include at least one set of the fitting protrusion and the fitting portion, and a total number of sets including the set of guiding protrusion and the guide portion of the guide engagement portions and the set of the fitting protrusion and the fitting portion of the fitting engagement portions is at least three.

8. The pair of plates for a rotary processing machine according to claim 3, wherein the guiding protrusion of the guide engagement portions and the fitting protrusion of the fitting engagement portions are removable.

9. The pair of plates for a rotary processing machine according to claim 8, wherein the guiding protrusion of the guide engagement portions and the fitting protrusion of the fitting engagement portions are made of resin.

10. The pair of plates for a rotary processing machine according to claim 2, wherein the guide portion of the guide engagement portions is any one of a long hole, a long groove, and a pair of protrusions which sandwich the guiding protrusion from two sides in the width direction, a selected one of the long hole, the long groove, and the pair of protrusions being formed with a longitudinal side thereof being oriented in the mount direction.

11. The pair of plates for a rotary processing machine according to claim 10, wherein the guiding protrusion of the guide engagement portions includes a tapered surface with a size thereof being gradually decreasing towards a tip-end side.

12. The pair of plates for a rotary processing machine according to claim 10, wherein the guide portion of the guide engagement portions includes a tapered surface with a size thereof being gradually increasing towards a side from which the guiding protrusion enters.

13. The pair of plates for a rotary processing machine according to claim 1, wherein each of the pair of plates is made of any one of a board and a sheet that is flexible so as to be capable of being curved along an outer circumferential surface of each of the cylinders.

14. The pair of plates for a rotary processing machine according to claim 1, wherein a batch operation with a single processing machine is performed to form the processing portion and the engagement portions formed in one of the pair of plates as well as a mount reference portion formed in the one of the pair of plates and used to mount the one of the pair of plates on the corresponding one of the cylinders, and a batch operation with exposure means is performed to form the processing portion and the engagement portions formed in the other one of the pair of plates.

15. A method of mounting the pair of plates for a rotary processing machine, the pair of plates being recited in claim 1, comprising:

positioning one of the plates with respect to the corresponding one of the cylinders, and mounting the one of the pair of plates on the one of the cylinders;

engaging the other one of the pair of plates with the one of the pair of plates by means of the engagement portions, and positioning the other one of the pair of plates with respect to the one of the pair of plates; and mounting the other one of the pair of plates on the corresponding other one of the cylinders, with the other one of the pair of plates being positioned with respect to the one of the pair of plates.

16. The method of mounting the pair of plates for a rotary processing machine according to claim 15, wherein the one of the pair of plates is mounted on the outer circumferential surface the one of the cylinders while the one and the other one of the pair of plates that are overlapped with each other and positioned by means of the engagement portions are curved along the outer circumferential surface of the one of the cylinders.

17. The method of mounting the pair of plates for a rotary processing machine according to claim 16, wherein the other one of the pair of plates is separated from the one of the pair of plates and mounted on the outer circumferential surface of the other one of the cylinders, while the pair of plates are made to pass between the pair of cylinders by rotating the pair of cylinders.

18. The method of mounting the pair of plates for a rotary processing machine according to claim 17, wherein the one and the other one of the pair of plates are temporarily fixed by overlapping the pair of plates with each other by means of a temporarily-fixing adhesive member in between, and the other one of the pair of plates is mounted on the outer circumferential surface of the other one of the cylinders by means of a mounting-purpose adhesive member that has stronger adhesion than the temporarily-fixing adhesive member.

* * * * *